US005699681A

United States Patent [19]

Nittmann

[11] Patent Number: 5,699,681

[45] Date of Patent: Dec. 23, 1997

[54] METHOD AND APPARATUS FOR PRECISION PATTERN KNITTING ON A WARP KNITTING MACHINE

[75] Inventor: Peter H. Nittmann, Wake Forest, N.C.

[73] Assignee: Albani Bayeux, Inc., Henderson, N.C.

[21] Appl. No.: 645,825

[22] Filed: May 14, 1996

[51] Int. Cl.[6] ..... D04B 27/14

[52] U.S. Cl. ..... 66/213

[58] Field of Search ..... 66/209, 211, 213, 66/82 A; 139/103, 109

[56] References Cited

U.S. PATENT DOCUMENTS

| | | | |
|---|---|---|---|
| 1,977,729 | 10/1934 | Lieberknecht | 66/82 A |
| 2,539,295 | 1/1951 | Cientimack | 66/211 |
| 3,036,448 | 5/1962 | Cundiff | 66/213 |
| 4,069,690 | 1/1978 | Smith | 66/213 |
| 4,382,371 | 5/1983 | Dale et al. | 66/213 |
| 5,375,435 | 12/1994 | Gille et al. | 66/209 X |

FOREIGN PATENT DOCUMENTS

| | | | |
|---|---|---|---|
| 1124225 | 10/1956 | France | 66/213 |
| 2243765 | 3/1973 | Germany | 66/213 |
| 602915 | 6/1948 | United Kingdom | 66/211 |

*Primary Examiner*—John J. Calvert

*Attorney, Agent, or Firm*—Richard E. Jenkins, P.A.

[57] ABSTRACT

A method and apparatus for controlling tension of lay-in warp yarns knitted on a warp knitting machine is provided for knitting a fabric having lay-in yarns with varying intermittent spacing between horizontally corresponding lengths thereof. The lay-in warp yarns of a warp knitting machine are preferably dividedly passed by two or more flutter bars which are simultaneously moveable in cooperation with one another to simultaneously and reciprocably increase/decrease and decrease/increase tension on lay-in warp yarns passing thereacross. Alternatively, the two or more flutter bars may simultaneously and reciprocably increase/increase and decrease/decrease tension on the corresponding lay-in warp yarns passing thereacross. Each flutter bar is a shaft with a parallel and spaced-apart contact arm for contacting yarn. The flutter bars are connected such that rotational movement by one flutter bar causes rotational movement of the other flutter bar. A reducer is utilized to motivate at least one of the flutter bars, and the reducer is driven by a servomotor controlled by a suitably programmed computer.

25 Claims, 6 Drawing Sheets

METHOD AND APPARATUS FOR PRECISION PATTERN KNITTING ON A WARP KNITTING MACHINE

TECHNICAL FIELD

The present invention relates generally to knitting fabric on a warp knitting machine. More particularly, the present invention relates to a method and apparatus for controlling tension of lay-in warp yarns on a warp knitting machine for knitting a fabric with lay-in warp yarns of varying intermittent spacing.

RELATED ART

Warp knitting is a type of knitting utilizing various warp yarns to knit fabrics which can have a variety of patterns. The foundation yarns, also referred to as the chain stitch or pillar stitch, are typically knitted in a fabric in a vertical alignment in relation to the lay-in warp yarns which generally step horizontally in the fabric and perpendicular to the foundation yarns. The lay-in warp yarns are prepared as warps on beams with one or more yarns for each needle used during the knitting process. Yarns from creels can also be utilized in warp knitting on Jacquard machines for knitting a predetermined Jacquard pattern. Examples of warp knitting machines and methods include "Tricot", "Milanese" and "Raschel".

It has been common during the general knitting process on a warp knitting machine for the lay-in warp yarns to pass across and be tensioned by spring-loaded flutter bars prior to actual knitting with the knitting needles. These flutter bars are not mechanically movable other than being somewhat resiliently movable in response to tension on the lay-in warp yarns by the connection of one or more compression springs to the flutter bars.

In the past, knitting of fabric on a warp knitting machine has been performed wherein the lay-in warp yarns have only been positioned in the resulting fabric in a straight alignment, parallel relative to one another and having a constant spacing between the lengths of a given pair of lay-in warp yarns. It has therefore been desirable to alter this traditional straight and parallel pattern and constant spacing between given lay-in warp yarns to achieve more interesting visual effects.

Applicant is aware of a prior art method and apparatus for knitting fabric on a "Low-Bar" Raschel warp knitting machine wherein the lay-in warp yarns have varying intermittent spacing therebetween rather than a constant spacing between the lengths of a given pair of the lay-in warp yarns. This method and apparatus first provided an ability to knit fabric on a Low-Bar Raschel warp knitting machine with the lay-in warp yarns forming what can be referred to as an "hourglass" shape wherein the lay-in warp yarns are knitted such that they repeatedly pinch close together and then spread apart along the length of the lay-in warp yarns rather than being more substantially parallel along their lengths with constant spacing between any given pair of lay-in warp yarns.

This prior art method and apparatus utilizes existing flutter bars that are connected to the main shaft of the Low-Bar Raschel warp knitting machine to mechanically drive the flutter bars. The flutter bars comprise shafts with spaced-apart and parallel contact arms which each contact the lay-in warp yarns dividedly passed thereover. The flutter bars are rotatable so as to alternatingly tighten and loosen the corresponding lay-in warp yarns passing across each flutter bar (e.g., alternately simultaneously tighten and loosen the warp yarns over corresponding flutter bars in the preferred embodiment or alternately simultaneously tighten all warp yarns and then simultaneously loosen all warp yarns in a second embodiment). The main shaft of the Low-Bar Raschel machine is connected by a sprocket and chain mechanism to a reducer which in turn rotates a plate 360° with the plate having an off-center threaded hole drilled therein which is connected to one of the flutter bars for causing rotation thereof. The flutter bars are connected at an opposite end thereof so that forced movement of one flutter bar causes the other flutter bar to move in an opposite direction in the preferred embodiment of the invention (and in the same direction in a second embodiment of the invention). This known mechanism allows tension on corresponding lay-in warp yarns dividedly passing across each flutter bar to alternatingly be increased and decreased by simultaneous movement of each flutter bar.

While the above-described method and apparatus for controlling tension on the lay-in warp yarns is effective for its intended purpose in providing additional fabric designing capabilities on a Low-Bar Raschel warp knitting machine, a number of disadvantages exist. For one, the mechanical connection of the flutter bars to the main shaft of the warp knitting machine limits the fabric design capabilities and fails to provide precise control of the tensioning of the lay-in warp yarns since the mechanical operation and control of the flutter bars allows only constant motion of the flutter bars without interruptions. Additionally, the known method and apparatus has only been used on Low-Bar Raschel warp knitting machines and is not suitable for use with Raschel Jacquard warp knitting machines which were subsequently developed and at times utilize patterns with an extremely long repeat, often upwards of 2,500 or more coarses. The constant motion of the flutter bars and the mechanical connection of the flutter bars to the main shaft in the existing method and apparatus for Low-Bar Raschel machines disadvantageously provides no precise synchronization of movement of the flutter bars with pattern chains and/or jacquard patterns.

Accordingly, there remains much room for improvement in the art of warp knitting for a method and apparatus for precisely controlling tension on selected yarns on warp knitting machines whereby fabrics can be knitted with lay-in warp yarns of varying intermittent spacing between the lengths thereof.

DISCLOSURE OF THE INVENTION

The present invention provides a method and apparatus for precisely controlling tension of lay-in warp yarns on a warp knitting machine whereby a fabric can be knitted with lay-in warp yarns of varying intermittent spacing between horizontally corresponding lengths thereof. At least one flutter bar is utilized with a warp knitting machine such that during knitting, at least a portion of the lay-in warp yarns to be knitted pass across the flutter bar prior to knitting. In the preferred embodiment, at least two flutter bars are utilized in a substantially parallel relationship and connected such that movement of one flutter bar causes simultaneous movement of the other. Each flutter bar comprises a shaft having a spaced-apart and parallel contact arm for contacting yarn.

At least one of the flutter bars is connected to a reducer which is driven by a computer controlled servomotor. In a preferred embodiment, the flutter bars can therefore be precisely controlled to rotate such that each flutter bar alternatingly increases or decreases tension on lay-in warp yarn passing thereacross as the other flutter bar oppositely increases or decreases tension on lay-in warp yarn passing thereacross. In this manner of controlling precisely the tension of at least some of the lay-in warp yarns immediately prior to knitting, the knitted fabric can have lay-in warp yarns of varying intermittent spacing between horizontally corresponding lengths thereof.

It is an object of the present invention to provide a novel method and apparatus for controlling tension of lay-in warp yarns knitted on a warp knitting machine.

It is another object of the present invention to provide a novel method and apparatus for knitting yarns on a warp knitting machine into a fabric with lay-in warp yarns of varying intermittent spacing between horizontally corresponding lengths thereof.

It is a further object of the present invention to provide a novel method and apparatus for accomplishing the above objects which is particularly suitable for use on a Raschel Jacquard warp knitting machine.

It is still a further object of the present invention to provide a method and apparatus for use on a warp knitting machine for production of knitted fabrics with more sophisticated patterns.

Some of the objects of the invention having been stated hereinabove, other objects will become evident as the description proceeds, when taken in connection with the accompanying drawings as best described hereinbelow.

BEST MODE FOR CARRYING OUT THE INVENTION

Figure 1:
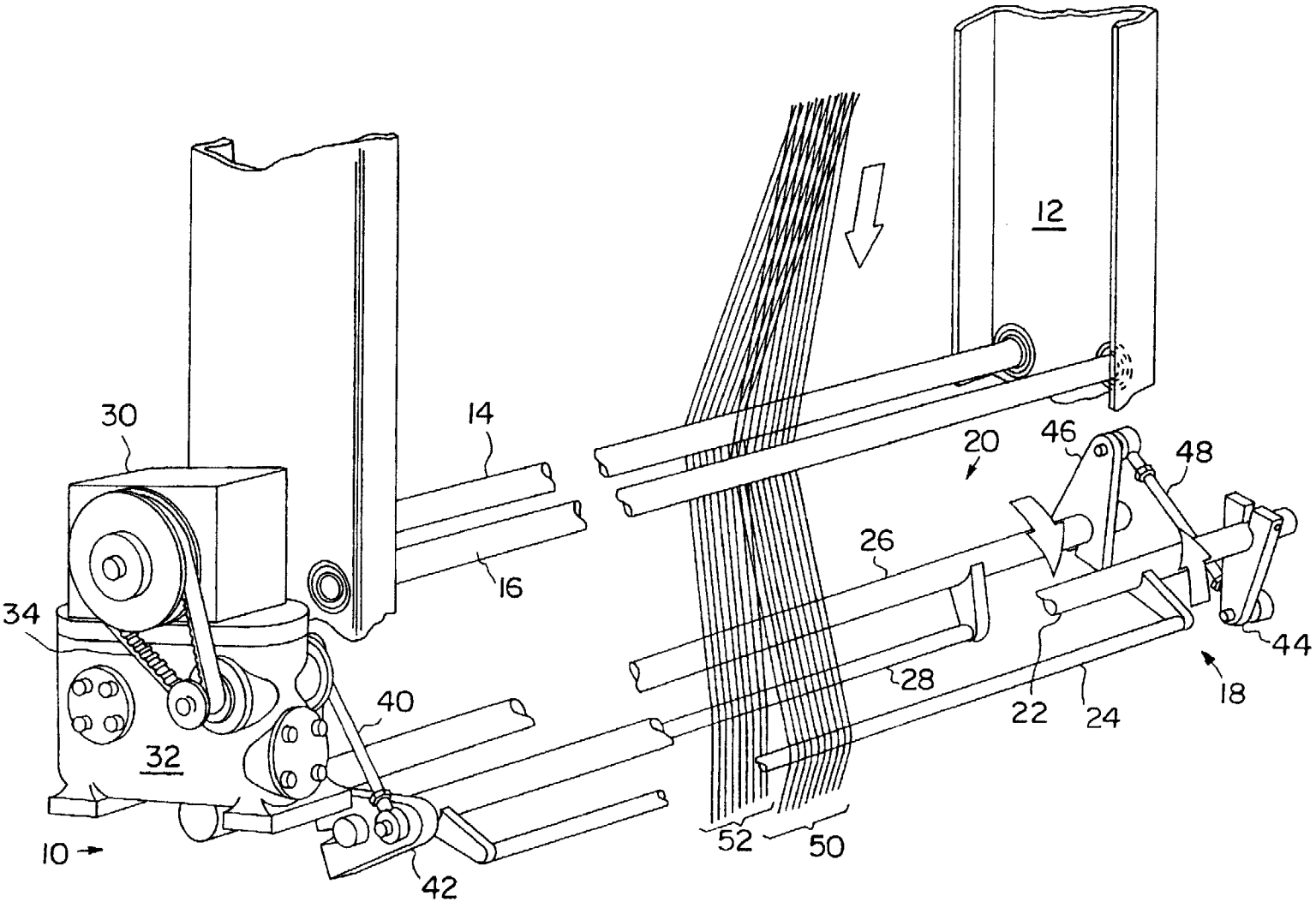
FIG. 1 of the drawings is a perspective view, with parts broken away for clarity of understanding, of a preferred embodiment of the apparatus of this invention attached to a warp knitting machine and illustrating lay-in warp yarns dividedly passing therethrough.

Referring now to FIGS. 1–7 of the drawings, the present invention provides an apparatus generally designated 10 which can be used to precisely control tension of selected yarns on a warp knitting machine so that fabric knitted thereon can have lay-in warp yarns of varying intermittent spacing between horizontally corresponding lengths of the lay-in warp yarns. FIG. 1 of the drawings illustrates apparatus 10 attached to frame 12 of a warp knitting machine having conventional diversion rods 14 and 16. It is also contemplated that apparatus 10 can work in association with a warp knitting machine without being attached thereto.

The warp knitting machine to which apparatus 10 is affixed, also known as a flat-bed knitting machine, can be of any type, including, for example, "Tricot", "Milanese" and "Raschel" knitting machines. While the present invention is particularly suitable for use on Raschel "Jacquard" knitting machines, it is specifically envisioned by applicant that the present invention can also be used with other types of Raschel machines, such as "Low-Bar" Raschel, "Fall-Plate" Raschel, and "Lace" Raschel machines in addition to non-Raschel warp knitting machines that are well known to one skilled in the art.

Apparatus 10 preferably comprises at least a pair of flutter bars 18 and 20 which are typically mounted to a conventional warp knitting machine. It is envisioned, however, that only one flutter bar could be utilized in accordance with this invention as described further hereinbelow. Each flutter bar can be of an identical structure as flutter bars 18 and 20 that comprise elongated rods or shafts 22 and 26, respectively, having parallel and spaced-apart contact arms 24 and 28, respectively, for contacting yarn wherein contact arms 24 and 28 can be formed as an integral part of shafts 22 and 26 or can be fixedly attached thereto. Each contact arm 24, 28 comprises an outer rod for contacting yarn wherein the rod can be constructed of any suitable material such as chromed metal. Each flutter bar 18 and 20 is rotatably movable around the center longitudinal axis of shafts 22 and 26, respectively, wherein the contact arm of each flutter bar is movable in the arc of a circle.

In accordance with applicant's invention, existing flutter bars 18 and 20, as described above, can be computer controlled for precise tension control of certain selected warp yarns passing thereacross. A computer controlled servomotor 30 drives a reducer 32 via connection to reducer 32 by belt or pulley 34. Flutter bar 18 is connected to reducer 32 as best illustrated in FIG. 2 of the drawings.

Figure 2:
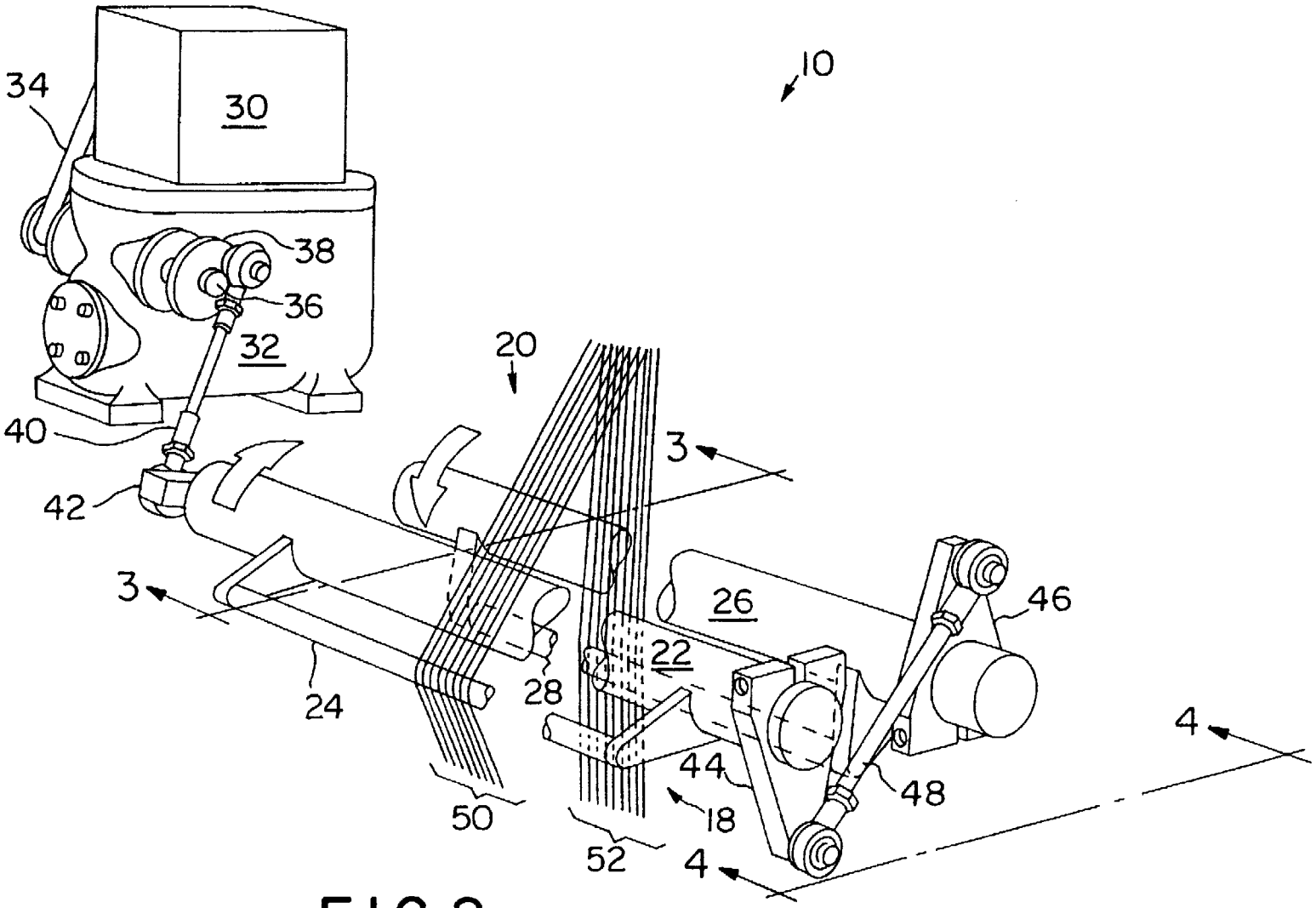
FIG. 2 of the drawings is a perspective view of the apparatus of this invention from the opposite side shown in FIG. 1 and illustrating lay-in warp yarns dividedly passing therethrough.
Figure 3:
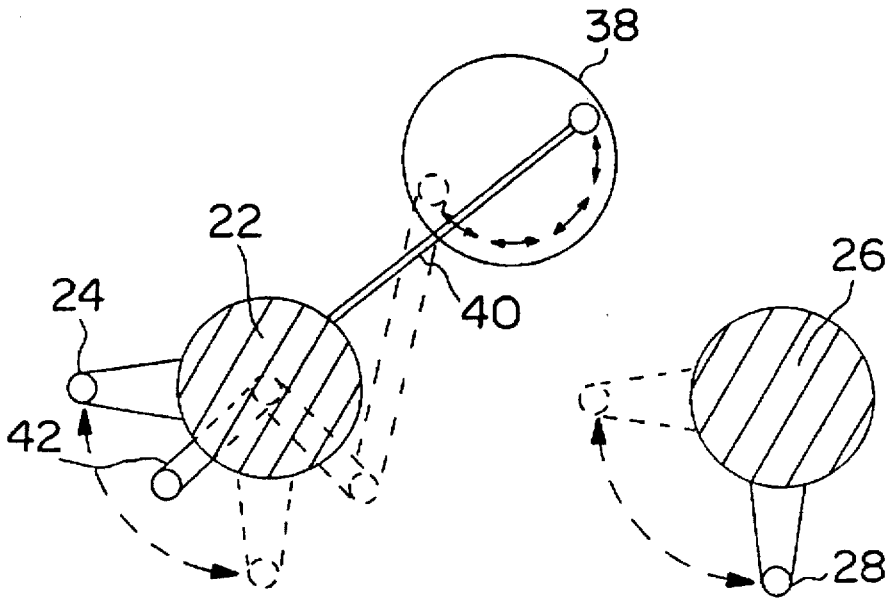
FIG. 3 of the drawings is a partial sectional view of the apparatus of this invention drawn along line 3—3 of FIG. 2.

Referring now to FIGS. 2 and 3 of the drawings, a reducer shaft 36 extends from and is rotatable by reducer 32 and has a rotation plate 36 concentrically mounted thereon. Rotation plate 38 has a movement arm 40 attached eccentrically thereto at one end with an opposite end of movement arm 40 being pivotably attached to arm 42 of flutter bar 18. Arm 42 can be fixedly attached to shaft 22 of flutter bar 18 or formed as an integral portion thereof. Reducer 32 preferably has a 40:1 ratio whereby forty (40) turns or rotations of reducer 32 as caused by servomotor 40 results in one turn or rotation of reducer shaft 36.

Rotation plate 38 is therefore rotatable 360° on reducer shaft 36. During operation of apparatus 10, however, reducer 32 is preferably driven so that rotation plate 38 moves back and forth in a range of approximately 0° to 180° in the arc of a circle. Operation of servomotor 30 therefore drives reducer 32 which causes reciprocating rotational movement of flutter bar 18.

Figure 4:
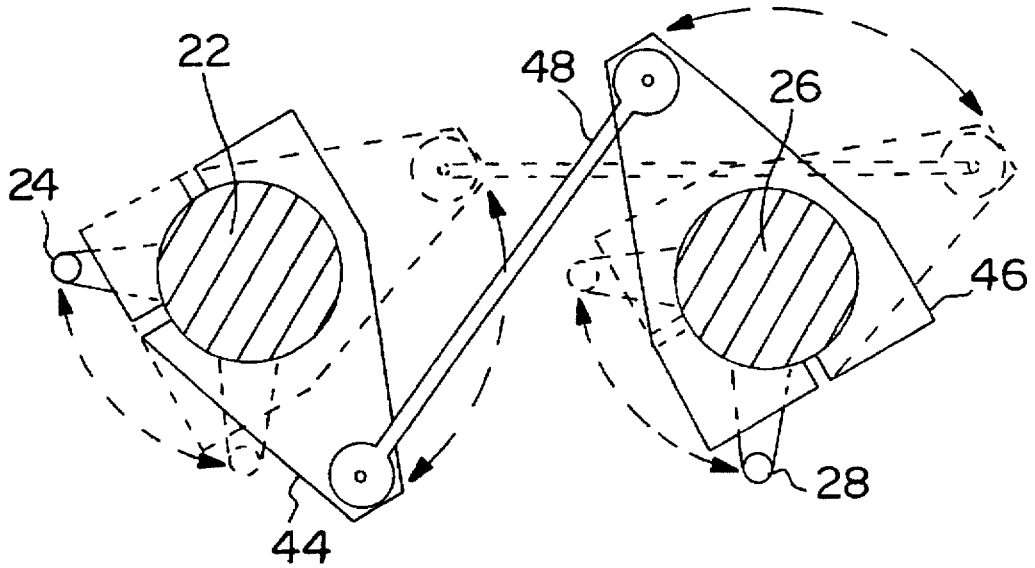
FIG. 4 of the drawings is a partial end view of the apparatus of this invention drawn along line 4—4 of FIG. 2 illustrating a preferred connection of the flutter bars.
Figure 4A:
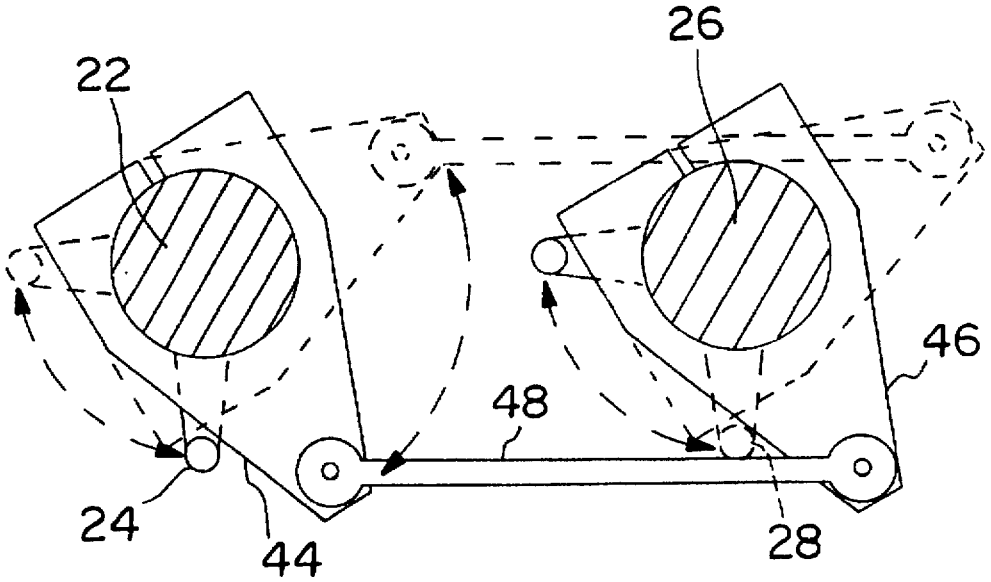
FIG. 4A of the drawings illustrates an alternative embodiment of the connection of the flutter bars according to this invention.

Referring now to FIGS. 2 and 4 of the drawings, flutter bars 18 and 20 are connected at one end thereof such that movement of flutter bar 18 causes simultaneous movement of flutter bar 20. End plates 44 and 46 are mounted on flutter bars 18 and 20, respectively, and a scissor arm 48 extends between and is movably connected to opposing ends of end plates 44 and 46 whereby rotational movement of one flutter bar causes opposite rotational movement of the other flutter bar as further described hereinbelow. It is also envisioned that flutter bars 18 and 20 could be connected as shown in FIG. 4A whereby rotational movement of one flutter bar causes rotational movement of the other flutter bar in the same direction.

Figure 5:
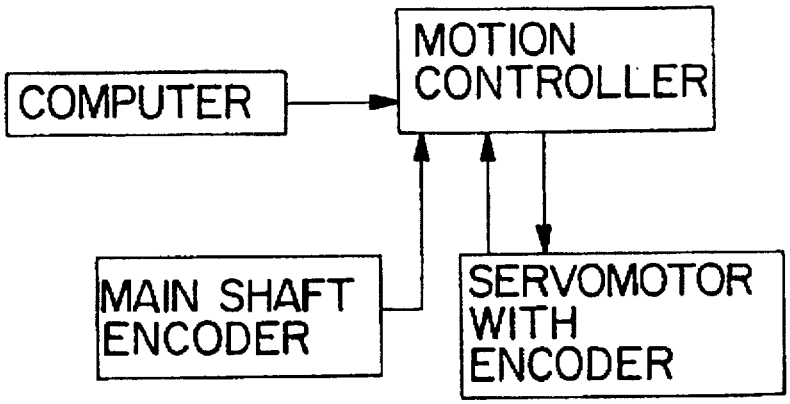
FIG. 5 of the drawings is a schematic illustration of the apparatus of this invention.

A schematic illustration of the apparatus and method of the present invention is provided in FIG. 5 of the drawings. As shown and discussed above, the reducer is driven by a servomotor. The servomotor can be a Parker/Compumotor brand Model No. 605 servomotor. A computer, such as a 486/33 megahertz Compaq brand PC, can be utilized in accordance with this invention and connected to the servomotor to precisely control the servomotor. A motion controller is preferably utilized in cooperation with the computer for control of the servomotor and can be a GALIL brand Model Number DMC-1500. A GALIL ICM-1100 Interconnect Module can be used to provide easy connections between the motion controller and the two (2) encoders which are described in detail hereinbelow.

Encoders such as the Dynamics Research Corporation encoder Model No. H25F031B16-1000, available from Dynamics Research Corporation can be utilized to communicate with the motion controller (and computer) by conveying information thereto. One encoder is preferably included inside the servomotor, and a second encoder is preferably utilized on the main shaft of the warp knitting machine. The computer can send movement commands to the servomotor via the motion controller and can receive position information back from the first servomotor encoder via the motion controller. The second servomotor encoder can convert the rotational movement of the servomotor shaft into encoder counts which constitute the information passed from the servomotor encoder to the motion controller to aid in positioning of the servomotor. The main shaft encoder is preferably configured to give a mark or pulse signal each time the main shaft completes a full rotation, and the servomotor can be caused by the computer and motion controller to begin a new move each time this mark or pulse is received by the motion controller (and computer). In this manner, information regarding the actual rotation of the main shaft of the warp knitting machine can be utilized by the computer to appropriately control action of the servomotor as desired.

Figure 6:
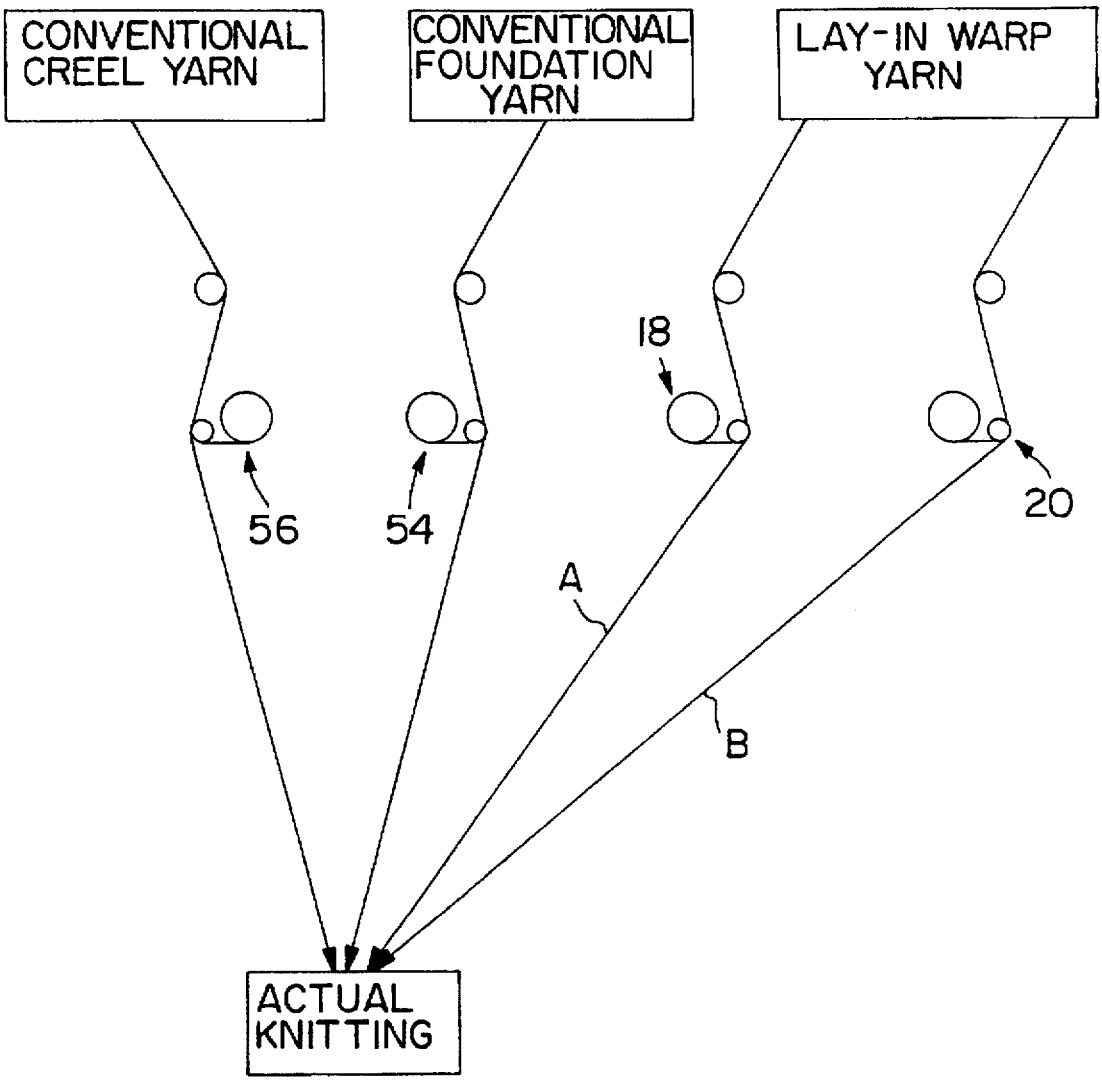
FIG. 6 of the drawings is a schematic illustration of a typical warp knitting machine showing the location of the apparatus of this invention.

A schematic illustration of a typical warp knitting process is provided in FIG. 6 showing the preferred location of computer controlled flutter bars 18 and 20 according to applicant's invention. As shown, the lay-in warp yarns pass dividedly across flutter bars 18 and 20 prior to actual knitting whereby corresponding portions of the lay-in warp yarns can be alternatingly tightened and loosened for and during actual knitting. Also as shown, conventional foundation yarn or chain stitch is typically used and passes by a traditional compression spring-loaded flutter bar 54. Conventional creel yarns can additionally be used for a Jacquard pattern where a Jacquard machine is used, and the creel yarn also passes by a traditional compression spring-loaded flutter bar 56.

Describing the method of this invention utilizing apparatus 10 and with reference to FIGS. 1–6 of the drawings, at least a portion and preferably all of the lay-in warp yarns used for knitting in a warp knitting machine dividedly pass across and are tensioned by corresponding flutter bars 18 and 20. In a typical warp knitting machine, the lay-in warp yarns utilized come from a warp beam and are passed by and against at least one diversion rod which changes the moving direction of and provides tension to the lay-in warp yarns prior to actual knitting. It is common for groups of the lay-in warp yarns of a knitted fabric to pass along separate paths from the warp beam and by one or a series of diversion rods prior to knitting in the warp knitting machine. These groups can be defined by the odd numbered and even numbered yarns or any other suitable group separation. FIGS. 1 and 2 illustrate groups of lay-in warp yarns 50 and 52 passing across flutter bars 18 and 20, respectively. Yarns 50 and 52 passing across flutter bars 18 and 20 actually contact and are tensioned by contact arms 24 and 28 of flutter bars 18 and 20, respectively.

In accordance with the preferred embodiment of applicant's invention, as yarns 50 and 52 pass across contact arms 24 and 28, flutter bars 18 and 20 simultaneously rotate in opposite directions such that the tension is simultaneously increased to yarns 50 and decreased to yarns 52 and then alternatingly decreased to yarns 50 and increased to yarns 52 by contact arms 24 and 28. Specifically, as flutter bar 18 rotates, contact arm 24 moves further against yarns 50 to increase tension of yarns 50. Simultaneously, as flutter bar 18 is rotating, scissor arm 48 causes flutter bar 20 to rotate in an opposite direction whereby contact arm 28 moves to decrease tension on yarns 52 passing thereacross. Yarns 50 and 52 are thereby simultaneously tightened and loosened and then loosened and tightened, respectively, by simultaneous movement of flutter bars 18 and 20. Although tension on yarns 50 and 52 can alternatingly be increased and decreased by rotation of flutter bars 18 and 20, respectively, the tension on either set of yarns preferably does not decrease to the point where the yarns lose contact with either contact arm 24 or contact arm 28. It can therefore be appreciated that contact arms 24 and 28 of flutter bars 18 and 20, respectively, continually provide tension to yarns 50 and 52, respectively, even as the tension is increased or decreased.

Figure 7:
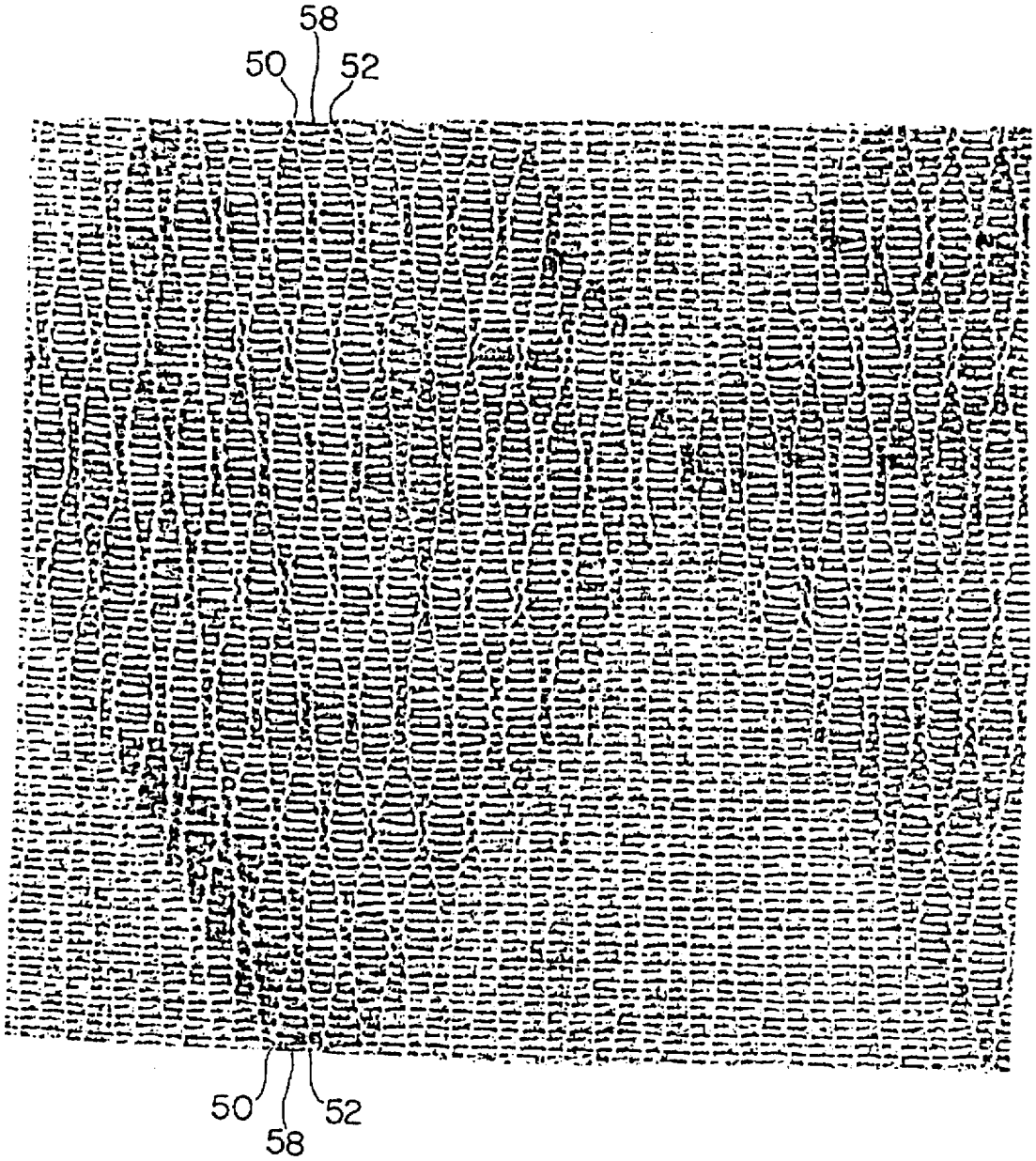
FIG. 7 is a drawing showing a representative "hourglass" design that can be knitted with a warp knitting machine utilizing the apparatus of this invention.

The fabric pattern obtained by utilizing flutter bars 18 and 20 as described above will be similar to a typical warp knitted fabric except the lay-in warp yarns will not be straight and parallel with consistent or constant spacing between the lengths of a given pair thereof. Rather, the lay-in warp yarns will be curved and have varying intermittent spacing between their lengths as they will be repeatedly pinched relatively close together and spread relatively apart. The precise pattern and spacing parameters of the lay-in warp yarns can be completely and easily controlled by computer control of flutter bars 18 and 20 with the computer suitably programmed for the specific pattern being knitted. While it can be appreciated that various patterns will be obtainable by altering tension of the lay-in warp yarns, one preferred pattern is the "hourglass" pattern (see FIG. 7) which can now be easily obtained and controlled as to precise size and shape and can be produced on a Jacquard machine. FIG. 7 illustrates lay-in warp yarns 50 and 52 and foundation yarns 58.

As an alternative embodiment of this invention, it is contemplated that flutter bars 18 and 20 can be connected as in FIG. 4A whereby rotational movement of flutter bar 18 causes rotational movement of flutter bar 20 in the same direction. While it can again be appreciated that various fabric patterns could thus be obtained, the lay-in warp yarns in a fabric using this method would not repeatedly pinch together and spread apart, but rather would create a pattern such as "overfeed and/or underfeed" while still being curved in a predetermined pattern.

It is also envisioned that only one flutter bar could be used to change tension on lay-in warp yarn passing thereacross. A fabric knitted while operating one flutter bar in this manner in cooperation with one or more traditional flutter bars not capable of controlled tension change would have a number of curved lay-in warp yarns and a number of traditionally straight lay-in warp yarns with the actual pattern depending upon which yarns pass across the flutter bar changing tension.

In accordance with this invention, the computer can be utilized to precisely control rotational movement of flutter bars 18 and 20. The pace and extent of movement of flutter bars 18 and 20 can be computer controlled, and contact arms 24 and 28 of flutter bars 18 and 20, respectively, preferably do not rotate more than approximately 100° in the arc of a circle during knitting according to this invention. The precise control rendered possible by use of the suitably programmed computer responding to real time data from the encoders operatively associated with the main shaft and servomotor renders the present method and apparatus particularly suitable for use with jacquard warp knitting machines. Movement of the flutter bars can now be patterned to the coarse (pattern) and/or the actual jacquard pattern itself, and movement of the flutter bars can be stopped, decreased or increased as desired for synchronization with a jacquard pattern.

It is therefore seen that the present invention provides a novel method and apparatus for knitting yarns on a warp knitting machine into a fabric with lay-in warp yarns of varying intermittent spacing. It can also be appreciated that the method and apparatus of the present invention provides a novel method for controlling tension of lay-in warp yarns knitted on a warp knitting machine. The method and apparatus of this invention can therefore be utilized with a warp knitting machine for production of knitted fabrics with more sophisticated patterns.

It will be understood that various details of the invention may be changed without departing from the scope of the invention. Furthermore, the foregoing description is for the purpose of illustration only, and not for the purpose of limitation as the invention is defined by the following, appended claims.

What is claimed is:

1. A method of knitting yarns on a warp knitting machine into a fabric with lay-in warp yarns wherein at least a portion of said lay-in warp yarns have varying intermittent spacing between the lengths thereof, said method comprising the steps of:

(A) dividedly passing at least a first and a second group of lay-in warp yarns to be knitted along separate paths prior to knitting in a warp knitting machine; and (B) increasing and decreasing tension of said first and second groups of lay-in warp yarns utilizing computer control means during knitting whereby said first and second groups of lay-in warp yarns tighten and loosen to cause said first and second groups of lay-in warp yarns to be knitted by the warp knitting machine with varying intermittent spacing between horizontally corresponding lengths of the lay-in warp yarns.

2. The method of claim 1 wherein tension of said first and second groups of lay-in warp yarns is simultaneously increased and decreased.

3. The method of claim 1 wherein tension of said first and second groups of lay-in warp yarns is alternatingly increased and decreased.

4. The method of claim 1 wherein the warp knitting machine includes at least a first and second flutter bar moveable in response to said computer control means, and wherein tension of said first and second groups of lay-in warp yarns is increased and decreased by said flutter bars moving as each flutter bar contacts one of said first or second groups of lay-in warp yarns to alternatingly tighten one of said groups and simultaneously loosen the other of said groups.

5. The method of claim 4 wherein the warp hitting machine further comprises a servomotor connected to said computer control means and a reducer connected to said servomotor and to at least one of said flutter bars, and further comprising the steps of using said computer control means using said servomotor to drive said reducer to move at least one of said flutter bars.

6. The method of claim 4 wherein said first and second flutter bars are connected such that movement of each flutter bar to increase or decrease tension of yarn passing thereacross simultaneously causes movement the other flutter bar to oppositely increase or decrease tension of yarn passing thereacross, and further comprising the step of using said computer control means to move one of said flutter bars which in turn simultaneously moves the other flutter bar.

7. The method of claim 1 further comprising knitting said yarns on a Raschel warp knitting machine.

8. The method of claim 7 further comprising knitting said yarns on a Raschel Jacquard warp knitting machine.

9. The method of claim 8 wherein each of said first and second flutter bars comprises a shaft rotatably attached to the warp knitting machine, each shaft having a parallel and spaced-apart contact arm for contacting yarn, and further comprising the step of rotating each of said shafts to rotate the contact arm of each flutter bar which tightens and loosens said first and second groups of warp yarns.

10. A method of controlling tension of lay-in warp yarns knitted on a warp knitting machine, said method comprising the steps of:

(A) providing one or more flutter bars working with a warp knitting machine, each of said one or more flutter bars contacting a corresponding portion of lay-in warp yarn to be knitted and which passes across each flutter bar, each flutter bar being capable of increasing and decreasing tension on the lay-in warp yarn passing thereacross;

(B) providing computer control and movement means for controlled movement of at least one of said one or more flutter bars; and (C) utilizing said computer control and movement means during knitting to move said one or more flutter bars such that said one or more flutter bars increases and decreases tension of lay-in warp yarn passing thereacross.

11. The method of claim 10 wherein said computer control and movement means comprises a computer-controlled servomotor and further comprising the step of driving a reducer which in turn moves at least one of said one or more flutter bars.

12. The method of claim 11 wherein a pair of interconnected flutter bars are provided and further comprising the step of moving one of said flutter bars to simultaneously move the other to oppositely increase or decrease tension of lay-in warp yarn passing thereacross.

13. The method of claim 10 wherein a pair of flutter bars are provided and said flutter bars comprise two substantially parallel shafts rotatably attached to the warp knitting machine with each shaft having a parallel and spaced-apart contact arm for contacting yarn, and further comprising the step of rotating each shaft to move each contact arm such that each contact arm moves lay-in warp yarn passing thereacross to increase and decrease tension.

14. In a warp knitting machine for knitting a plurality of yarns into a fabric, the improvement comprising an apparatus for controlling tension of lay-in warp yarns, said apparatus comprising:

(A) at least a pair of rotatable flutter bars working with a warp knitting machine for each contacting a respective divided-out portion of lay-in warp yarn to be knitted and which passes across each flutter bar, each flutter bar being moveable such that each flutter bar during knitting can increase and decrease tension on the lay-in warp yarn which passes thereacross and said flutter bars being connected such that rotational movement of one causes rotational movement of the other;

(B) movement means connected to at least one of said flutter bars for moving at least one of said flutter bars during knitting; and (C) computer means connected to and controlling said movement means;

(D) whereby said computer means can cause said movement means to move at least one of said flutter bars during knitting which moves the other of said flutter bars such that said flutter bars can during knitting increase and decrease tension on the lay-in warp yarn which passes thereacross.

15. The apparatus of claim 14 wherein said flutter bars comprises substantially parallel shafts rotatably attached to the warp knitting machine with each shaft having a parallel and spaced-apart contact arm for contacting yarn.

16. The apparatus of claim 14 wherein said flutter bars are connected at one end whereby rotational movement of one of said flutter bars causes opposite rotational movement of the other flutter bar and whereby said flutter bars can alternatingly increase and decrease tension of the lay-in warp yarn which passes thereacross.

17. The apparatus of claim 14 wherein said flutter bars are connected to one end whereby rotational movement of one of said flutter bars causes rotational movement of the other flutter bar in a same direction.

18. The apparatus of claim 14 wherein the warp knitting machine includes lay-in warp yarns to be knitted which contact said flutter bars wherein said flutter bars provide constant tension on said lay-in warp yarns.

19. In a warp knitting machine comprising lay-in warp yarns for knitting into a fabric, the improvement comprising an apparatus for controlling tension of the lay-in warp yarns, said apparatus comprising:

(A) at least a first flutter bar and a second flutter bar, each of the flutter bars contacting a respective divided-out portion of lay-in warp yarn to be knitted and which passes across each flutter bar, and each flutter bar being rotatably movable such that each flutter bar can alternatingly increase and decrease tension of lay-in warp yarn passing thereacross;

(B) said flutter bars being connected at one end thereof such that movement of said first flutter bar to increase or decrease tension of the lay-in warp yarn passing thereacross causes simultaneous movement of said second flutter bar to oppositely increase or decrease tension of the lay-in warp yarn passing thereacross;

(C) a reducer operatively connected to said first flutter bar for moving said first flutter bar;

(D) a servomotor driveably connected to said reducer; and (E) computer means connected to said servomotor for controlling said servomotor;

(F) whereby said computer means can actuate said servomotor to drive said reducer to move said first flutter bar to in turn simultaneously move said second flutter bar such that said flutter bars can alternatingly increase and decrease tension of the lay-in warp yarns passing thereacross.

20. The apparatus of claim 19 wherein the warp knitting machine is a Raschel Jacquard warp knitting machine.

21. In a warp knitting machine for knitting lay-in warp yarn into a fabric, the improvement comprising an apparatus for controlling tension of at least a portion of the lay-in warp yarn, said apparatus comprising:

(A) at least one rotatably moveable flutter bar comprising a shaft having a parallel and spaced-apart contact arm for tensioning lay-in warp yarn prior to knitting, said flutter bar being rotatable on a longitudinal axis of said shaft whereby said contact arm also rotates such that said contact arm can during knitting increase and decrease tension on lay-in warp yarn passing thereacross;

(B) movement means operatively connected to said flutter bar for rotating said flutter bar during knitting; and (C) computer means operatively connected to and controlling said movement means;

(D) whereby said computer means can cause said movement means to rotate said flutter bar during knitting.

22. The apparatus of claim 21 wherein the warp knitting machine includes lay-in warp yarn to be knitted which passes across and is tensioned by said contact arm of said flutter bar.

23. In a warp knitting machine for knitting a plurality of yarns into a fabric, the improvement comprising an apparatus for controlling tension of lay-in warp yarns, said apparatus comprising:

(A) at least a pair of rotatable flutter bars working with a warp knitting machine for each contacting a respective divided-out portion of lay-in warp yarn to be knitted and which passes across each flutter bar, each flutter bar being moveable such that each flutter bar can increase and decrease tension on the lay-in warp yarn which passes thereacross and said flutter bars being connected such that rotational movement of one causes rotational movement of the other;

(B) movement means connected to at least one of said flutter bars for moving at least one of said flutter bars;

(C) computer means connected to and controlling said movement means;

(D) whereby said computer means can cause said movement means to move at least one of said flutter bars which moves the other of said flutter bars such that said flutter bars can increase and decrease tension on the lay-in warp yarn which passes thereacross; and (E) wherein said movement means is connected to an end of a first of said flutter bars and said flutter bars are connected to each other at an opposite end such that movement of said first flutter bar causes simultaneous movement of the other of said flutter bars.

24. In a warp knitting machine for knitting a plurality of yarns into a fabric, the improvement comprising an apparatus for controlling tension of lay-in warp yarns, said apparatus comprising:

(A) at least a pair of rotatable flutter bars working with a warp knitting machine for each contacting a respective divided-out portion of lay-in warp yarn to be knitted and which passes across each flutter bar, each flutter bar being moveable such that each flutter bar can increase and decrease tension on the lay-in warp yarn which passes thereacross and said flutter bars being connected such that rotational movement of one causes rotational movement of the other;

(B) movement means connected to at least one of said flutter bars for moving at least one of said flutter bars;

(C) computer means connected to and controlling said movement means;

(D) whereby said computer means can cause said movement means to move at least one of said flutter bars which moves the other of said flutter bars such that said flutter bars can increase and decrease tension on the lay-in warp yarn which passes thereacross; and (E) wherein said movement means comprises a reducer for moving at least one of said flutter bars and a servomotor driveably connected to said reducer.

25. In a warp knitting machine for knitting a plurality of yarns into a fabric, the improvement comprising an apparatus for controlling tension of lay-in warp yarns, said apparatus comprising:

(A) at least a pair of rotatable flutter bars working with a warp knitting machine for each contacting a respective divided-out portion of lay-in warp yarn to be knitted and which passes across each flutter bar, each flutter bar being moveable such that each flutter bar can increase and decrease tension on the lay-in warp yarn which passes thereacross and said flutter bars being connected such that rotational movement of one causes rotational movement of the other;

(B) movement means connected to at least one of said flutter bars for moving at least one of said flutter bars;

(C) computer means connected to and controlling said movement means;

(D) whereby said computer means can cause said movement means to move at least one of said flutter bars which moves the other of said flutter bars such that said flutter bars can increase and decrease tension on the lay-in warp yarn which passes thereacross; and (E) wherein said movement means comprises a reducer for moving at least one of said flutter bars and a servomotor driveably connected to said reducer and wherein said computer means is connected to and controls said servomotor.

* * * * *